US005746655A

United States Patent [19]

Lee

[11] Patent Number: 5,746,655

[45] Date of Patent: May 5, 1998

[54] METHOD AND APPARATUS FOR OPENING AND CLOSING AN AIR OUTLET OF AN AIR CONDITIONER

[75] Inventor: Gab-Youl Lee, Suwon, Rep. of Korea

[73] Assignee: Samsung Electronics Co., Ltd., Suwon, Rep. of Korea

[21] Appl. No.: 763,142

[22] Filed: Dec. 10, 1996

[51] Int. Cl.[6] ..... F24B 13/20

[52] U.S. Cl. ..... 454/233; 454/234; 454/306; 454/316; 454/324

[58] Field of Search ..... 454/230, 229, 454/231, 233, 234, 256, 306, 309, 313, 316, 324

[56] References Cited

U.S. PATENT DOCUMENTS 4,020,753 5/1977 Efstratis ..... 454/306
4,545,379 10/1985 Jenkins ..... 454/306 X
5,461,875 10/1995 Lee et al. ..... 454/324 X

FOREIGN PATENT DOCUMENTS 6-123466 5/1994 Japan .

*Primary Examiner*—Harold Joyce
*Attorney, Agent, or Firm*—Burns, Doane, Swecker & Mathis, L.L.P.

[57] ABSTRACT

An air conditioner includes a housing having an air inlet at its lower end. An air outlet is formed in an air discharge member which is mounted at an upper end of the housing. The discharge member is vertically movable relative to the housing, whereby the outlet is closed by a portion of the housing when the discharge member is in a lowermost position and becomes progressively opened as the discharge member is raised. Sensors are provided for detecting various positions of the discharge member during its vertical movement. The discharge member is moved by a main electric motor, and an auxiliary motor is moved into an operative position for vertically moving the discharge member when the main motor malfunctions.

16 Claims, 11 Drawing Sheets

METHOD AND APPARATUS FOR OPENING AND CLOSING AN AIR OUTLET OF AN AIR CONDITIONER

BACKGROUND OF THE INVENTION

1. Field of the Invention

The present invention relates to an air conditioner having a discharge outlet to be opened or closed for preventing dust or foreign substances from passing through the discharge outlet, and more particularly to a discharge outlet opening or closing apparatus for the air conditioner.

2. Description of the Prior Art

A conventional air conditioner has, as shown in FIG. 1, a main body 1, a suction inlet 3 arranged to suck a room air at the bottom portion of a front face of the body 1, a discharge outlet 5 for discharging indoors the air heat-exchanged by a heat-exchanger with cold or warm air, the outlet situated at an upper portion of a front face of the body 1, and a cover member 7 attached to the body 1 and usually designed to give a good appearance thereto and for protecting the interior thereof.

The discharge outlet 5 has blades 9 and 11 for adjusting left or right and upward or downward the air discharged indoors through the discharge outlet 5, respectively, and is provided with a discharge outlet door 13 usually designed to give a good appearance. The door is installed upon a front face to open the discharge outlet 5, and to close the discharge outlet 5 for preventing dust or foreign substances from passing through the discharge outlet 5 and into the main body 1 during the stand-by state of the air conditioner.

Also, driving means adapted for moving upward or downward the discharge outlet door 13 includes a supporting member 15 attached to an upper front surface of the body 1, and a door motor 17 fixed to the supporting member 15, for moving upward or downward the discharge outlet door 13. A pinion 19 is axially coupled to a shaft of the door motor 17 to be rotated by the door motor 17, and a rack 21 is mounted on the door for changing a rotary motion of the pinion 19 into a straight linear motion to move upward or downward the discharge outlet door 13 when the pinion 19 is rotated. Guides 23 are mounted on the housing for guiding the travel of the discharge outlet door 13.

Furthermore, photo-sensors 25 and 27 are respectively installed at upper and lower portions of the discharge outlet door 13 and at upper and lower portions of the guide 23, for detecting an open or a closed state of the discharge outlet door 13 for automatically controlling the up or down movement of the discharge outlet door 13.

If a user selects a desired operational mode through a remote controller or a manual manipulating panel and then depresses a start/stop key (hereinafter referred to as the operation key), the door motor 17 is rotated in the forward direction to thereby rotate the pinion axially coupled to the shaft of the door motor 17, so that downward movement of the rack 21 caused by the pinion 19 causes the discharge outlet door 13 to be also moved downward, thus opening the discharge outlet 5.

At this time, when the photo-sensors 25 and 27 detect that the discharge outlet 5 is opened, the door motor 17 stops, and at the same time an indoor fan, not illustrated, is rotated to take in the room air into the body 1 through the suction inlet 3. Then, the room air introduced into the body 1 through the suction inlet 3 is heat-exchanged by the evaporating latent heat of the refrigerant flowing in the heat-exchanger when the sucked air passes through the heat-exchanger.

The air heat-exchanged through the heat-exchanger is guided into an upper portion of the body 1 and then discharged indoors in an air flow direction according to a controlled displacement of air vanes or blades 9, 11 for accomplishing the conditioning of the room air.

If the operation key is OFF during a normal operation of the air conditioner, the door motor 17 is rotated in the reverse direction to cause the discharge outlet door 13 to be moved upward, and thus the discharge outlet 5 is closed. At this time, when the photo-sensors 25 and 27 detect that the discharge outlet 5 is closed, the door motor 17 stops, and the air conditioner maintains its stand-by state until the operation key is again ON.

Even if the conventional air conditioner has merit in that the closing of the discharge outlet 5 prevents introduction of dust or foreign substances into the main body 1, there is a problem in that the air discharge position cannot be varied, for the discharge outlet 5 is fixed. Therefore, the conventional air conditioner cannot be adapted for changing the discharge position due to the state and dimension of the space in a room to be conditioned, and the place at which the air conditioner is to be installed, etc. Furthermore, since the air conditioner includes the indoor fan and the heat-exchanger, etc., and the discharge outlet 5 is fixed on the upper portion thereof, the overall size of the product is relatively long, which makes it difficult to deliver the product which occupies a wider space in installing the air conditioner.

Moreover, since the photo-sensor 25, 27 for detecting the discharge outlet door 13 which moves upward or downward is mounted adjacent to the discharge outlet 5, and since undesirable moisture may be produced during the conditioning of the air, the photo-sensor 25, 27 may malfunction. Furthermore, the door motor 17 may be out of order. In case of these occurrences, the discharge outlet door 13 cannot be opened or closed, which causes a problem since the air conditioner cannot be used.

SUMMARY OF THE INVENTION

Therefore, it is an object of the present invention to provide a discharge outlet opening or closing apparatus for the air conditioner whose discharge outlet can be placed at various positions and whose vertical length can be varied, and an associated method.

It is another object of the present invention to provide a discharge outlet opening or closing apparatus for an air conditioner in which a position of a discharging means can be accurately detected, and a moving operation of the discharging means can be accurately performed using an auxiliary motor when degradation or a malfunction of a main motor for moving upward or downward the discharging means occurs.

The above objects are accomplished by an air conditioner having an apparatus for closing or opening a discharge outlet, the air conditioner being adapted for taking in and heat-exchange indoor air, and then discharging the heat-exchanged air, wherein the apparatus comprising:

discharging means having a discharge outlet at one side thereof, which is vertically moved at an upper portion of a main body, for thereby defining a vertical position of the discharge outlet with the movement of the discharging means;

driving means for vertically moving the discharging means;

closing/opening detecting means for detecting positions of the discharging means moved; and control means for controlling the driving means based upon a detection result from the closing/opening detecting means.

Furthermore, according to another aspect of the present invention, there is provided a method for closing or opening a discharge outlet of the air conditioner of the present invention, the method comprising the steps of:

establishing a desired discharging position at which discharging means is to be positioned;

controlling driving means in response to the established discharging position and moving upward or downward the discharging means; and detecting positions of the discharging means moving upward or downward.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

The preferred embodiment according to the present invention will now be described in detail in accordance with the accompanying drawings.

Figure 1:
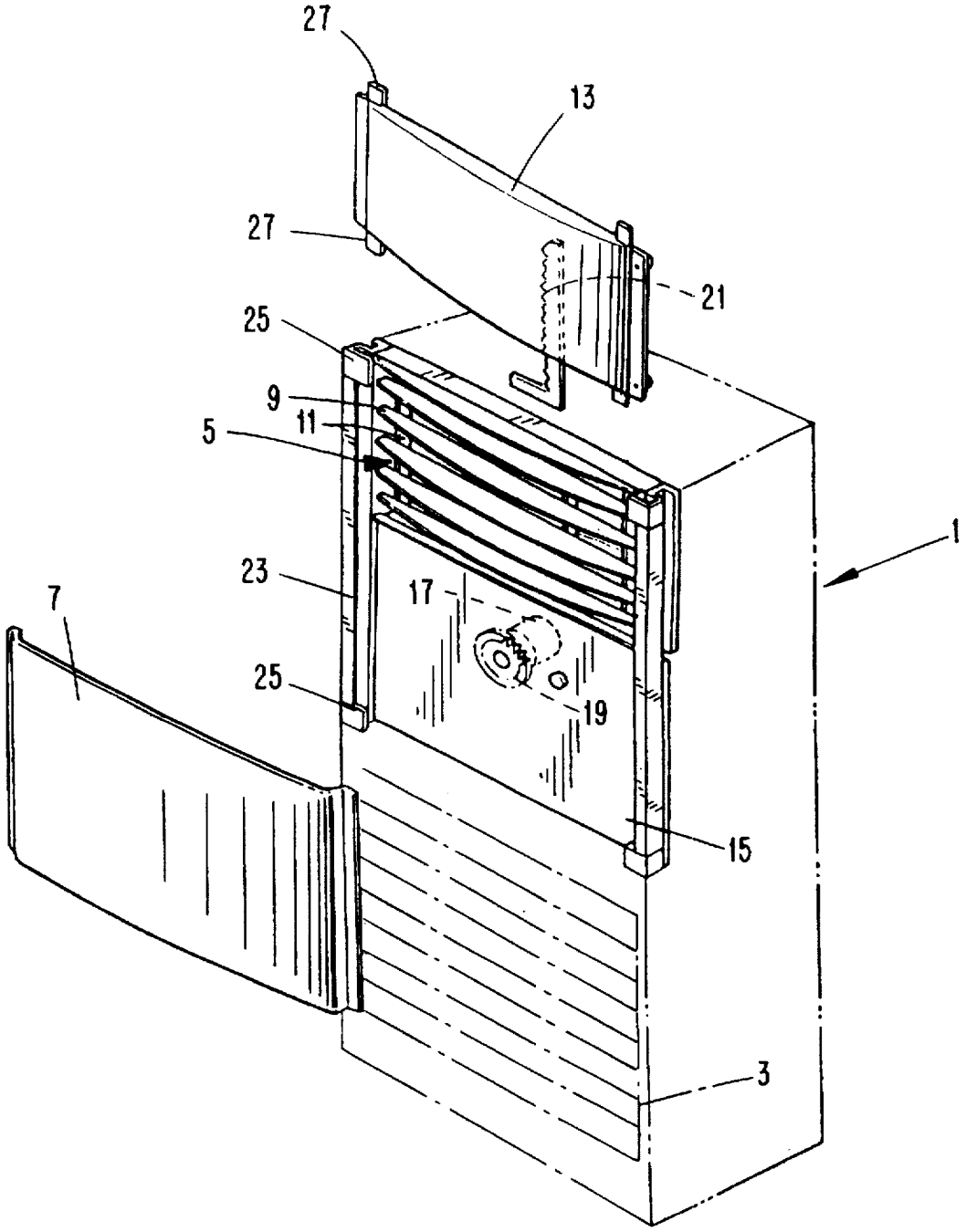
FIG. 1 (PRIOR ART)
FIG. 1 is an exploded schematic front perspective view illustrating a discharge outlet opening or closing apparatus for a conventional air conditioner.
Figure 2:
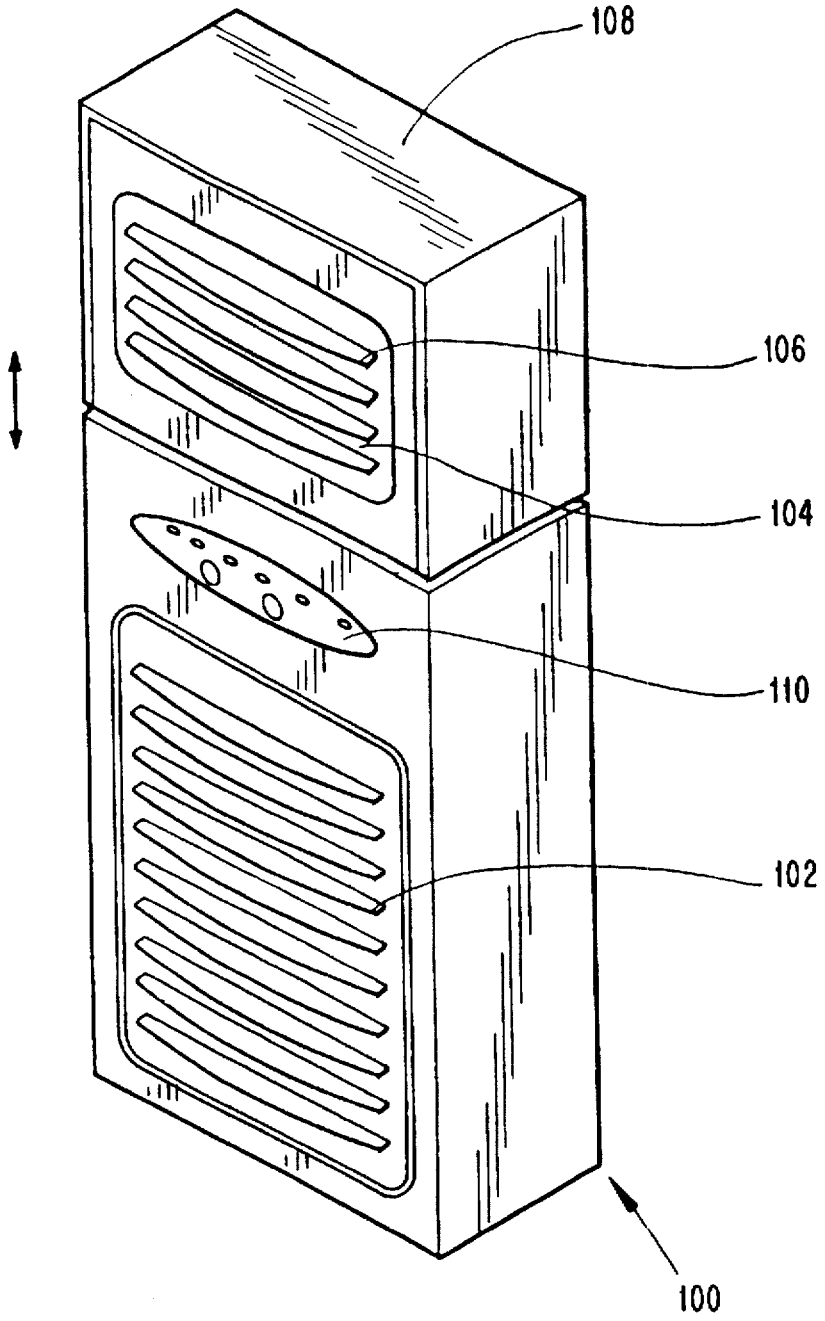
FIG. 2 is a schematic front perspective view illustrating an air conditioner according to the present invention, with the discharge outlet closed.
Figure 3:
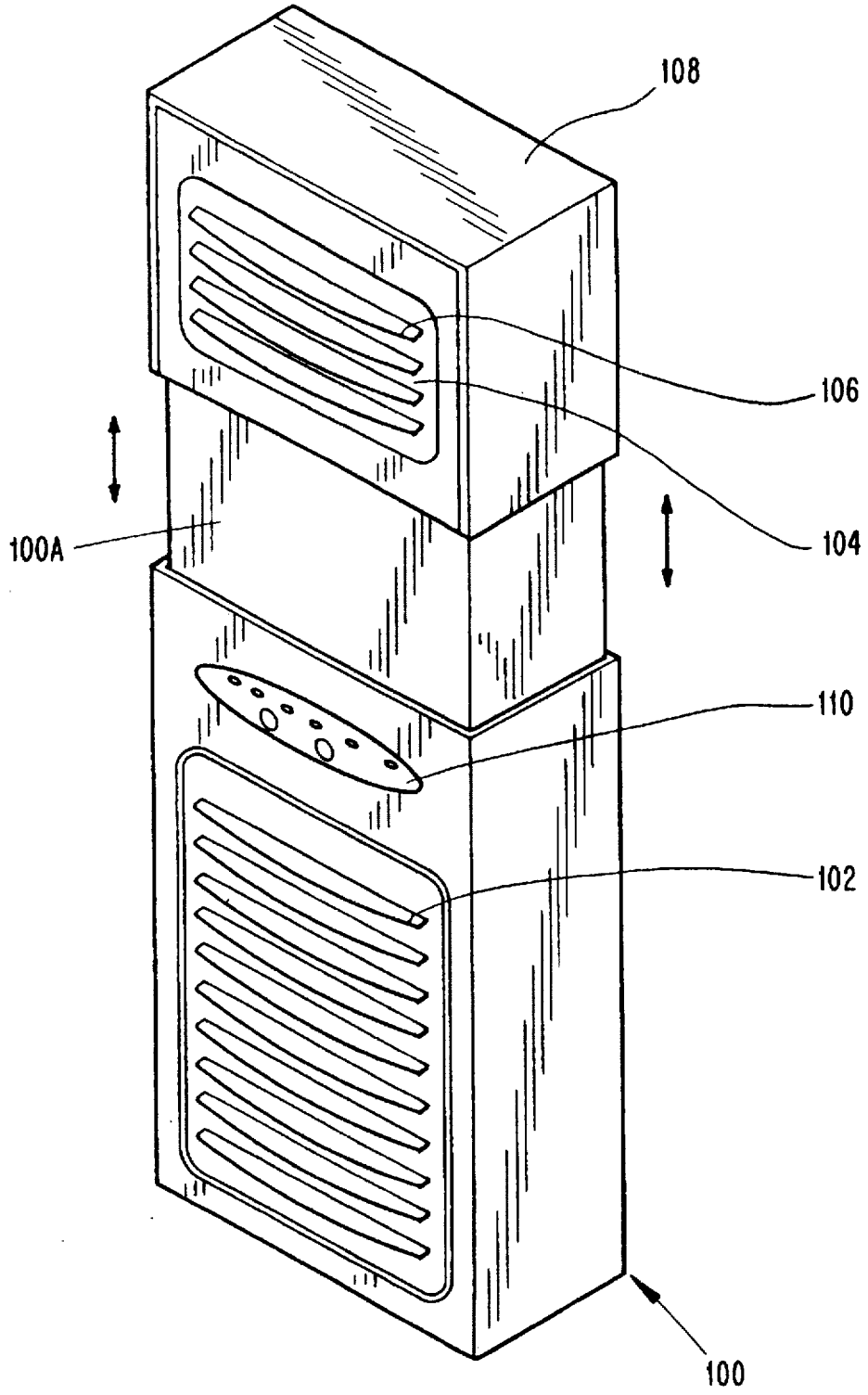
FIG. 3 is a schematic front perspective view illustrating an air conditioner according to the present invention, with the discharge outlet opened.

As shown in FIG. 2 and FIG. 3, a main body 100 has a suction inlet 102 arranged to suck a room air at the bottom portion of a front face of the body 100, and a discharge outlet 104 for discharging indoors the air heat-exchanged by a heat-exchanger, not illustrated, which serves to heat-exchange the air with cold or warm air. The outlet is situated at the upper portion of the front face and is pivotally provided with blades 106 for adjusting a flow direction of the discharged air from the discharge outlet 104. Also, the blades 106 are connected to an internal motor, not illustrated, for adjusting the displacement of the blades 106.

The main body 100 is provided on an upper portion thereof with discharging means 108 having the discharge outlet 104, where the discharging means serves to open the discharge outlet during the operation of the air conditioner, and to close the discharge outlet 104 for preventing dust or foreign substances from passing through the discharge outlet 104 and into the main body during the stand-by state of the air conditioner. The discharging means 108, designed to give a good appearance, is a box-shaped structure having a partially opened front surface constituting the discharge outlet 104, and an opened bottom, and is adapted to be moved upward and downward as shown in FIG. 3.

And, above an area at which the suction inlet 102 is located, there is disposed a manual manipulating portion 110 for directing desired operation modes of the air conditioner such as automatic mode, cooling, heating, defrost, air-cleaning, and so forth, and a start/stop of the air conditioner, and for adjusting the flow amount or flow direction of the air discharged through the discharge outlet 104.

Figure 4:
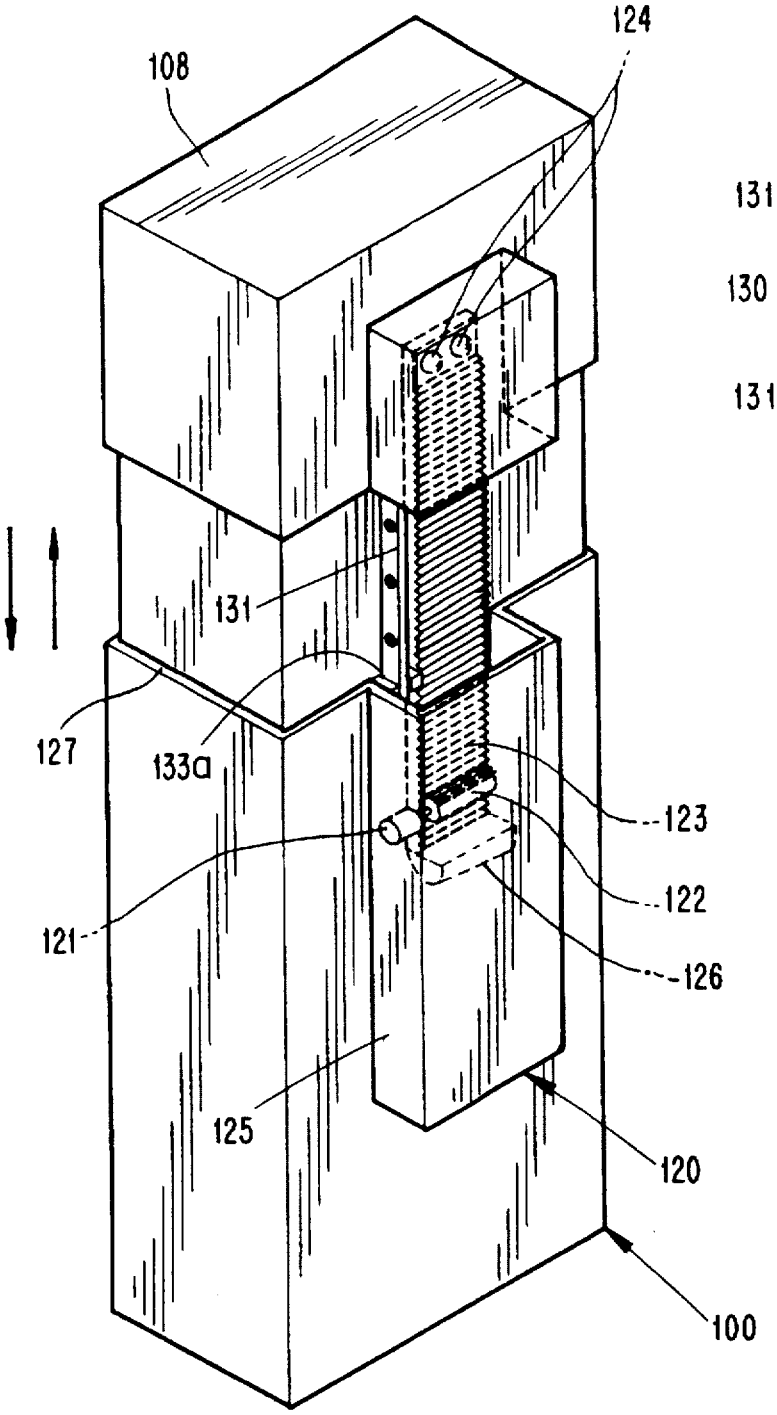
FIG. 4 is a rear perspective view illustrating the configuration of ascending or descending means according to an embodiment of the present invention.
Figure 4A:
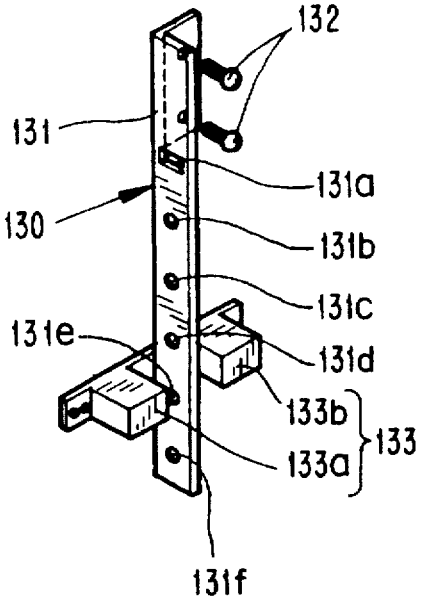
FIG. 4A is a perspective view of a detecting mechanism used in FIG. 4.

Referring to FIG. 4, the main body 100 has a rear surface on which a motor 121 for moving up or down the discharging means 108 is fixedly installed. The motor 121 has a shaft axially coupled to a pinion 122. The discharging means 108 is provided at a rear surface thereof with a vertically elongated rack 123 having one end fixed to the discharging means 108 by means of a coupling member 124. The rack is for changing the rotary motion of the pinion 122 into linear motion in cooperation with teeth of the pinion 122. A guide means 120 has a guide wall 125 for guiding the up or down movement of the rack 123 and also additionally serving to support the motor 121.

A lower portion of the rack 123 is provided with a stopper 126 for limiting the upward travel distance of the discharging means 108 to less than the overall height dimension of the rack 123. This allows an upper limiting position of the discharging means 108 to be defined by the stopper 126. And, a lower limiting position of the discharging means 108 is defined by a stepped portion 127 formed in the main body 100, for this stepped portion contacts the lower portion of the discharging means 108 and restrains further downward movement thereof 108.

Upward straight line motion of the rack 123 caused by the rotary motion of the pinion 122 due to the rotation of the motor 121 causes the discharging means 108 to move upward whereby the outlet 104 travels above a front wall 100A of the body 100 and thereby becomes opened. The air sucked through the suction inlet 102 is discharged indoors through the discharge outlet 104 wherein the higher the discharging means 108 is elevated, the wider the discharge outlet 104 is opened, and vise versa.

The discharging means 108 has a sensor actuating member 131 fixedly coupled thereto on the rear side of the discharging means 108 by means of a coupling member 132, where the sensor driving member 131 has a plurality of equidistantly located holes **131*a* through 131*f*, such that each of the holes corresponds to a given position of the discharging means 108** elevated.

The main body 100 is provided at its rear surface with a photo-sensor 133 having a light emitting portion **133*a* and a light receiving portion 133*b* which can be triggered by a plurality of holes 131*a* through 131*f* of the sensor actuating member 131. The ON/OFF state of the photo-sensor 133 is due to the plurality of holes 131*a* to 131*f* which pass through the passage between the light emitting portion 133*a* and the light receiving portion 133*b* of the photo-sensor 133 in response to the ascending or descending of the discharging means 108. The sensor actuating member 131 and the photo-sensor 133 constitute an elevation detecting mechanism 130**.

The member 131, when the motor 121 is rotated in either the forward or reverse direction, ascends and descends through a space formed between the light emitting portion 133*a* and the light receiving portion 133*b* of the photo-sensor 133, thus allowing any one of the holes 131*a* through 131*f* to conduct the light emitted from the light emitting portion 133*a* to the light receiving portion 133*b*. Control means, of which details will be discussed later, counts the number of detection signals received from the photo-sensor 133 and determines the current position of the moved discharging means 108.

The discharging means 108 can be at any one of 1st through 5th positions with the following relationship: 1st position <2nd position <3rd position <4th position <5th position, i.e. the fifth position is the highest. A plurality of holes 131*a* to 131*f* formed in the sensor driving member 131 include 1st through 5th holes 131*b*, 131*c*, 131*d*, 131*e*, 131*f* for respectively detecting the position of the discharging means 108 at any of the respective 1st through 5th positions.

Next, the configuration of the ascending or descending means in accordance with another preferred embodiment of the present invention will be described with reference to FIGS. 5 and 6.

Figure 5:
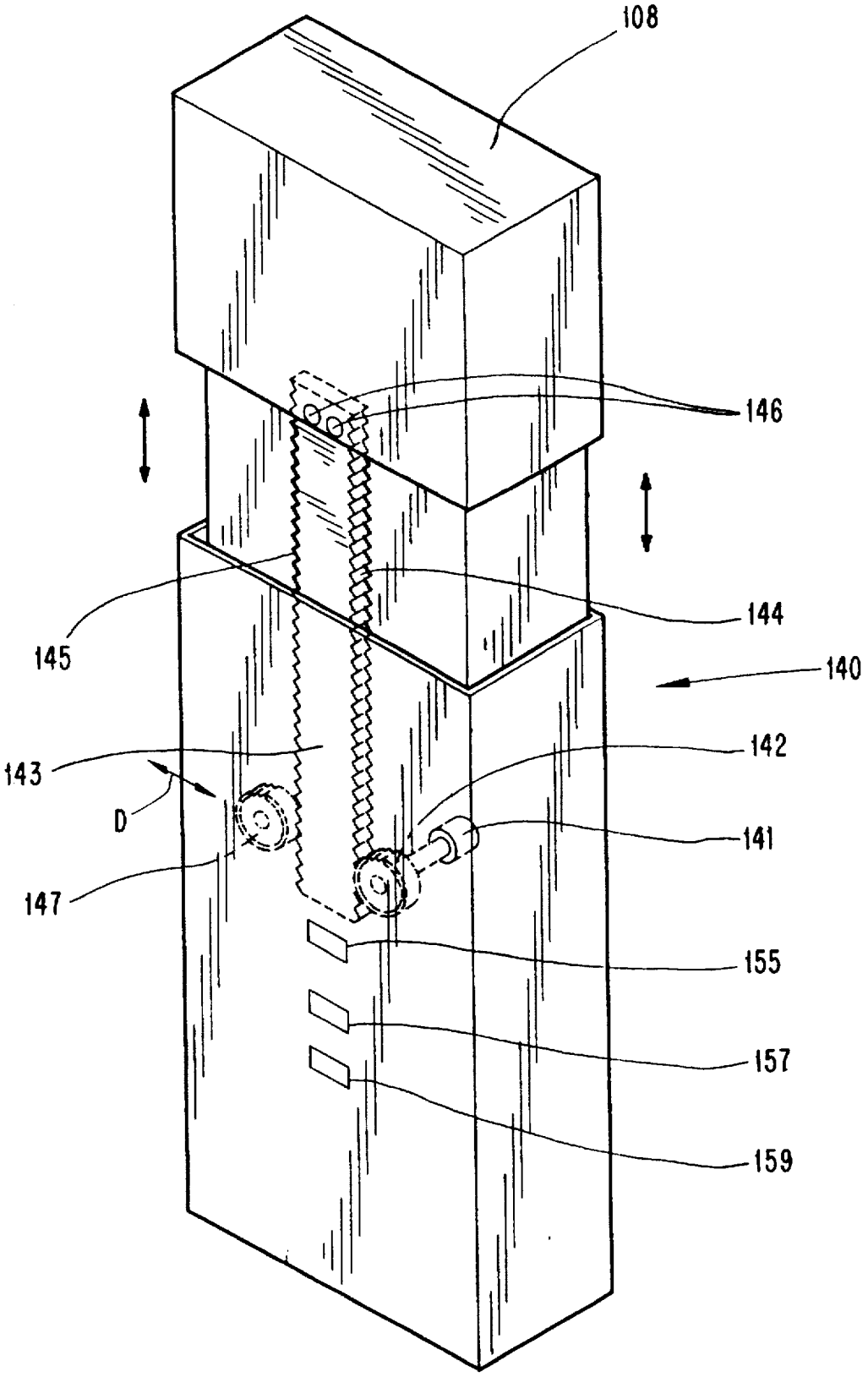
FIG. 5 is a rear perspective view illustrating the configuration of ascending or descending means according to another embodiment of the present invention.

As shown in FIG. 5, the main body 140 has a rear surface upon which a motor 141 for moving upward or downward the discharging means 108 is fixedly mounted. The door motor 141 has a shaft axially coupled to a pinion 142. The discharging means 108 is provided at a rear surface thereof with rack 143 having one end fixed to the discharging means 108 by means of a coupling member 146 and gears 144, 145 formed on both of sides of the rack 143, for changing the rotary motion of a pinion 142 into linear motion in cooperation with teeth of the pinion gear 142. The motor 141 rotates the pinion 142 engaged with the right gear 144 of the rack 143 for exercising up or down straight linear motion and for thereby moving upward or downward the discharging means 108.

Position sensors 155, 157, 159 are disposed in line with the rack for detecting the position of the moved rack, where the positions to be detected include upper limiting, reference and lower limiting positions. Preferably, each of the position sensors 155, 157, 159 may comprise a photo-interrupter mounted on the housing 140.

Figure 6:
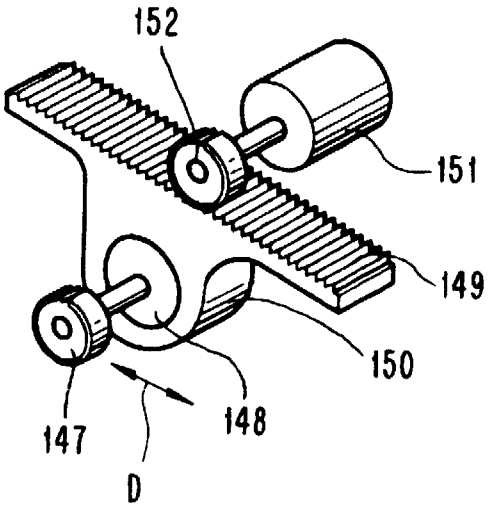
FIG. 6 is a schematic perspective view of a mechanism for transferring an auxiliary motor in FIG. 5.

Meanwhile, as shown in FIG. 6, to cope with the degradation of the door motor 141 and to enable the rack 143 to be moved despite a degraded door motor 141, an auxiliary pinion 147 is spaced a short distance from the gear 145 formed on the left side of the rack 143. The pinion 147 is axially coupled to a shaft of an auxiliary motor 148 supported by a transfer member 150 having a transfer rack 149 formed on a longitudinally extended top portion of the transfer rack 149. And, since the transfer rack 149 engages with a transfer pinion 152 axially coupled to a shaft of a transfer motor 151 to transfer the pinion 147 toward or away from the gear 145 in a direction D. Hence, the auxiliary pinion 147, in case of degradation of the door motor 141, is engaged with the left gear 145 of the rack 143.

Hereinafter, for such a structured air conditioner, the control for moving upward or downward the discharging means 108 will be described with reference to FIGS. 7 and 8.

Figure 7:
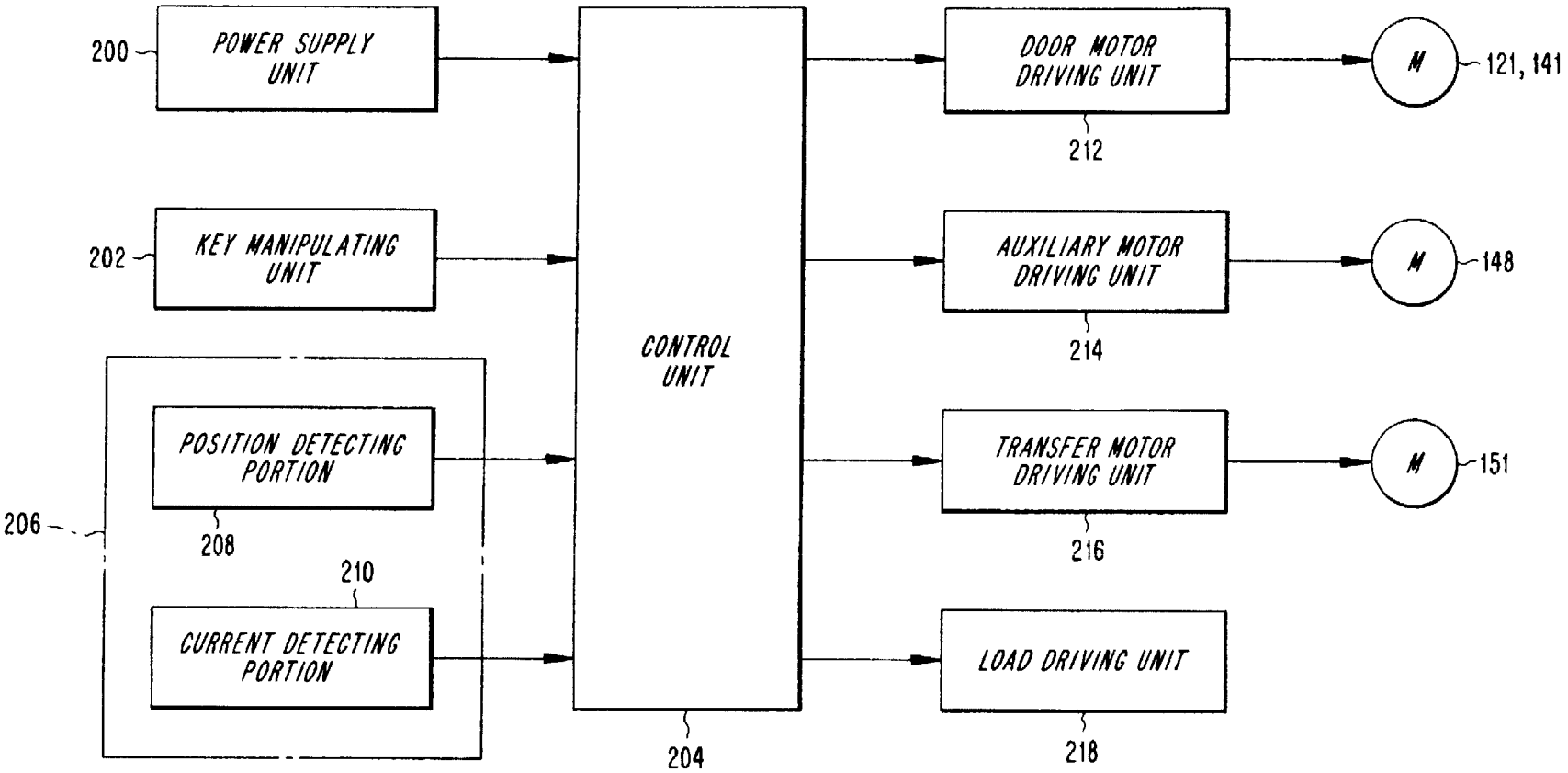
FIG. 7 is a control block diagram of the discharge outlet opening or closing apparatus for the air conditioner according to the present invention.
Figure 8:
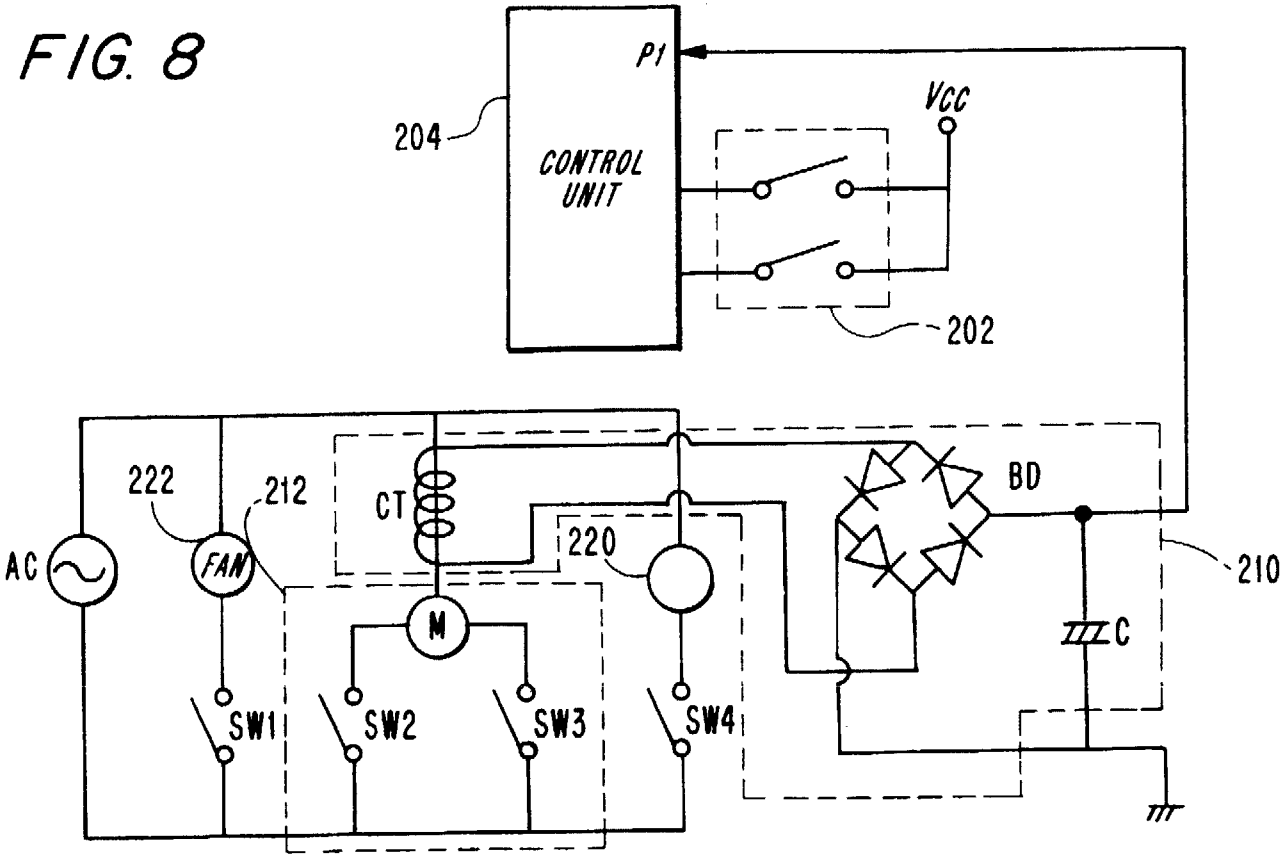
FIG. 8 is a detailed circuit diagram of a control system according to the present invention.

As shown in FIGS. 7 and 8, power supply means 200 serves to receive an electrical source voltage of commercial AC electrical power supplied from an AC power source stage 101, not illustrated, to convert the same to a predetermined DC voltage necessary for operation of the air conditioner and output the same. Key manipulating means 202 has a plurality of keys for selectively establishing the operational modes such as automatic mode, cooling, heating, defrost, air-cleaning, and so forth, of the air conditioner, an amount of air flow such as strong, weak, soft and so forth and the desired temperature Ts (hereinafter, referred to as a set temperature), as well as an operation key for a start/stop of the air conditioner and an outlet position adjusting key for adjusting and establishing various positions of the discharging means 108 within the predetermined range.

Control means 204, which may comprise a microprocessor, receives direct voltage output from the power supply means 200 to initialize the air conditioner, and also controls a general operation of the air conditioner in response to an operation selection signal input through the key manipulating means 202. Also, the control means 204 controls the movement of the discharging means 108 in response to the key input signal through the key manipulating means 202.

Position detecting means 206 is provided for detecting a closed or open state of the discharge outlet 104, corresponding to the position of the discharge outlet 108, and for outputting the detected signal to the control means 204. The position detecting means 206 comprises a position detecting portion 208 for detecting a specific position resulting from the up or down movement of the discharging means 108 and an electric current detecting portion 210 for detecting an electric current generated in response to a closed or an open state of the discharge outlet 104. The position detecting portion 208 may be embodied by the ascending or descending portion 130, or by the position sensors 155, 157, 159.

An electric current detecting portion 210 of the position detecting means 206 includes a transformer CT for detecting an electric current flowing through a winding of the door motor 121, such that when further movement of the discharging means 108 past the upper and lower limiting positions is restrained by stops, an abrupt rise of the electric current due to the stationary state of the door motor is detected for identifying the arrival at the upper limiting position of the discharging means 108. Such identified arrival is signaled to the control means 204, via a bridge diode BD for full-wave rectifying the current detected by the transformer CT, and a smoothing capacitor C for filtering ripple components contained in the full-wave rectified DC current.

Motor driving means 212 including motors 121, 141 and switching elements SW2, SW3 for controlling supply of the power into the motors 121, 141 is provided to establish rotation directions of the door motors 121, 141 based upon the control signal output from the control means 204 for controlling the movement of the discharging means 108 in compliance with the key input signal through the key manipulating means 202. Auxiliary motor driving means 214 is provided to control the driving of the auxiliary motor 148 based upon the control signal output from the control means 204 for controlling the movement of the discharging means 108 in cooperation with the motors 121, 141 in case of a degradation of the motors 121, 141.

Transfer motor driving means 216 is provided to control the driving of the transfer motor 151 based upon the control signal output from the control means 204 for transferring the auxiliary motor 148. Load driving means 208, including switching elements SW1, SW4 for controlling supply of the power into the compressor 220 and indoor fan 222, is provided to control the driving of the compressor 220, the indoor fan 222 and a blade 106 for adjusting air flow direction under the control of the control means 204.

The operation and advantages of such a structured discharge outlet closing/opening apparatus for the air conditioner and method therefor will be described.

Figure 9A:
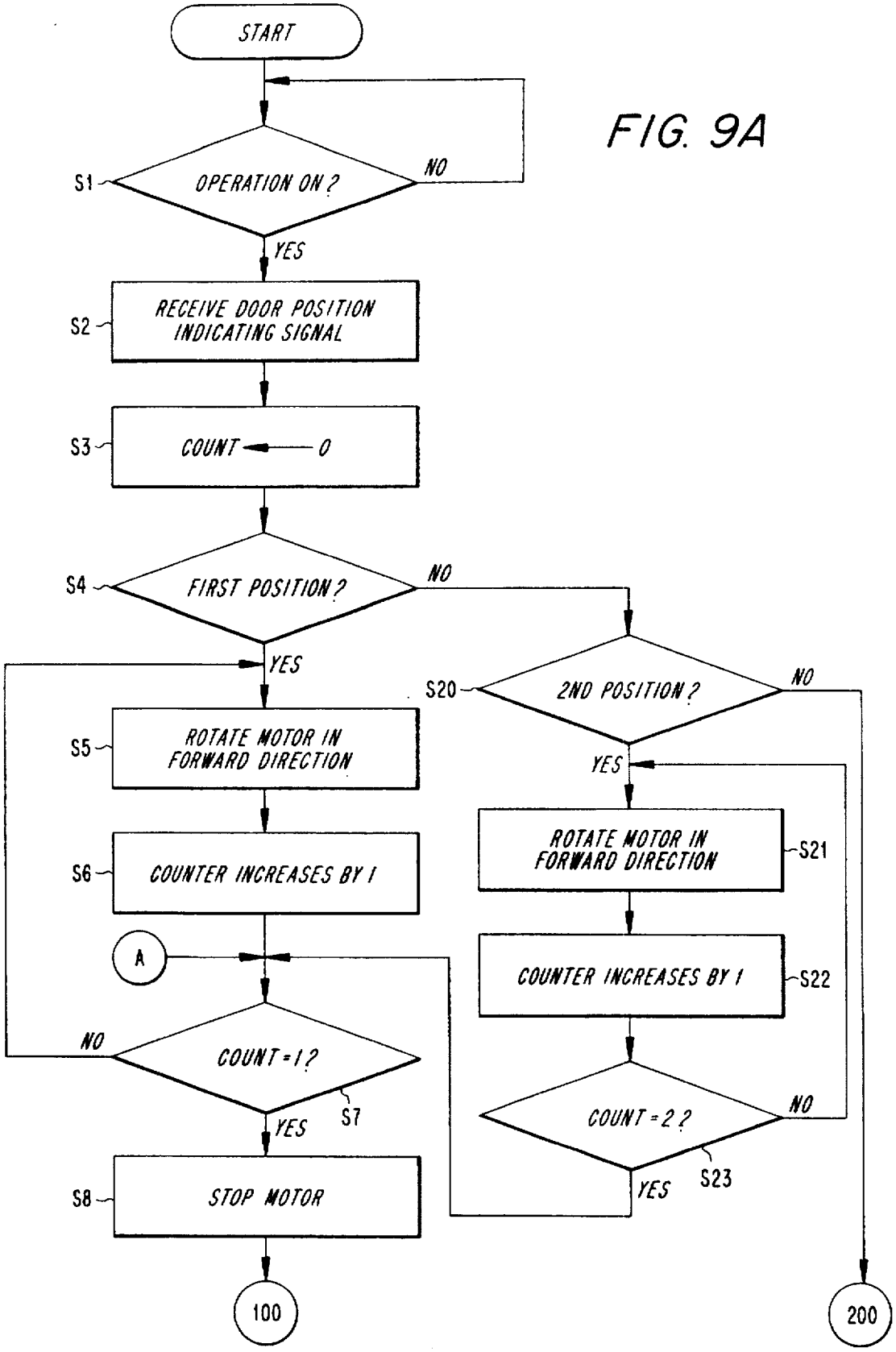
FIG. 9A–9C are flow charts illustrating sequential control procedures for opening or closing the discharge outlet of the air conditioner.
Figure 9B:
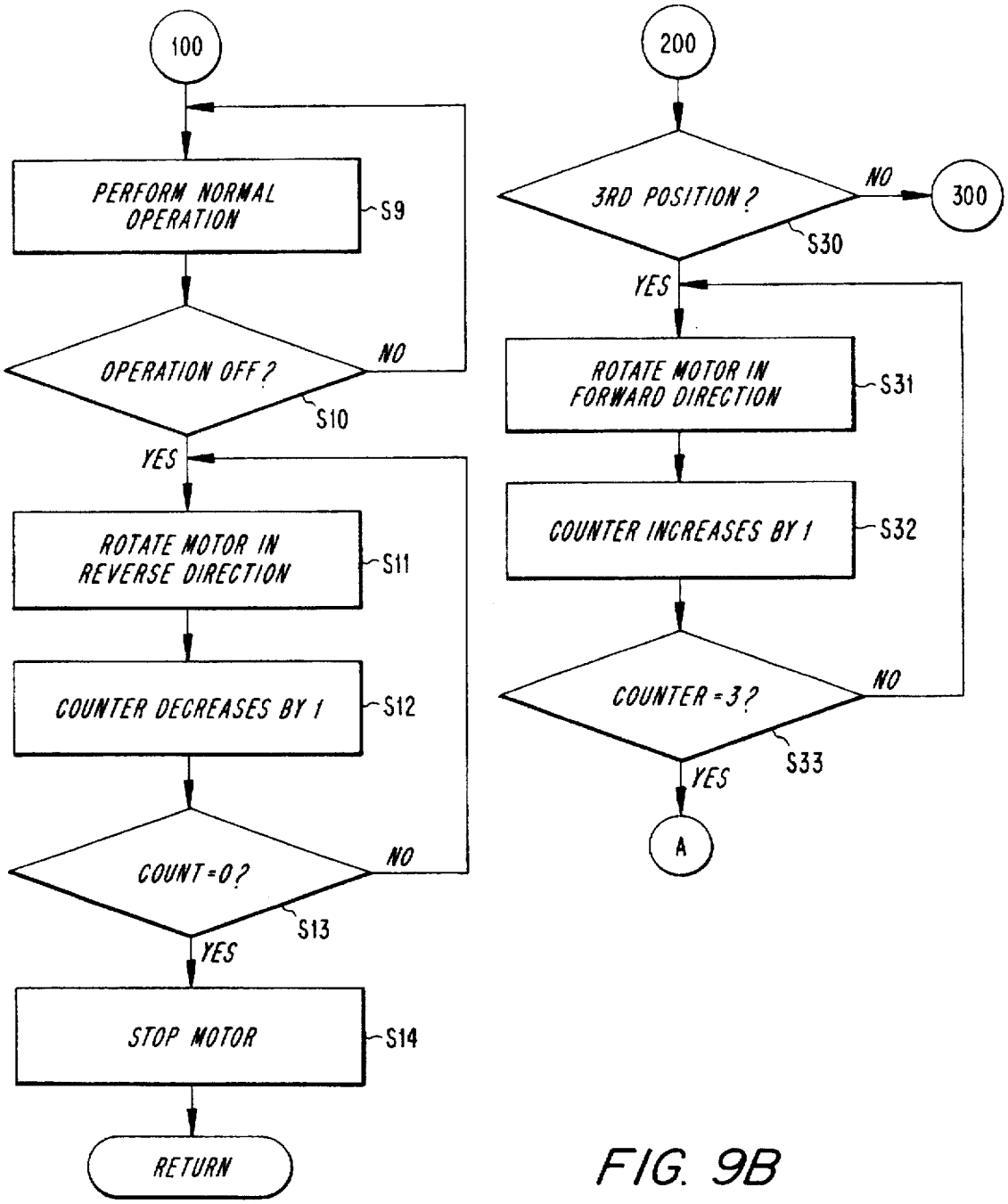
Figure 9C:
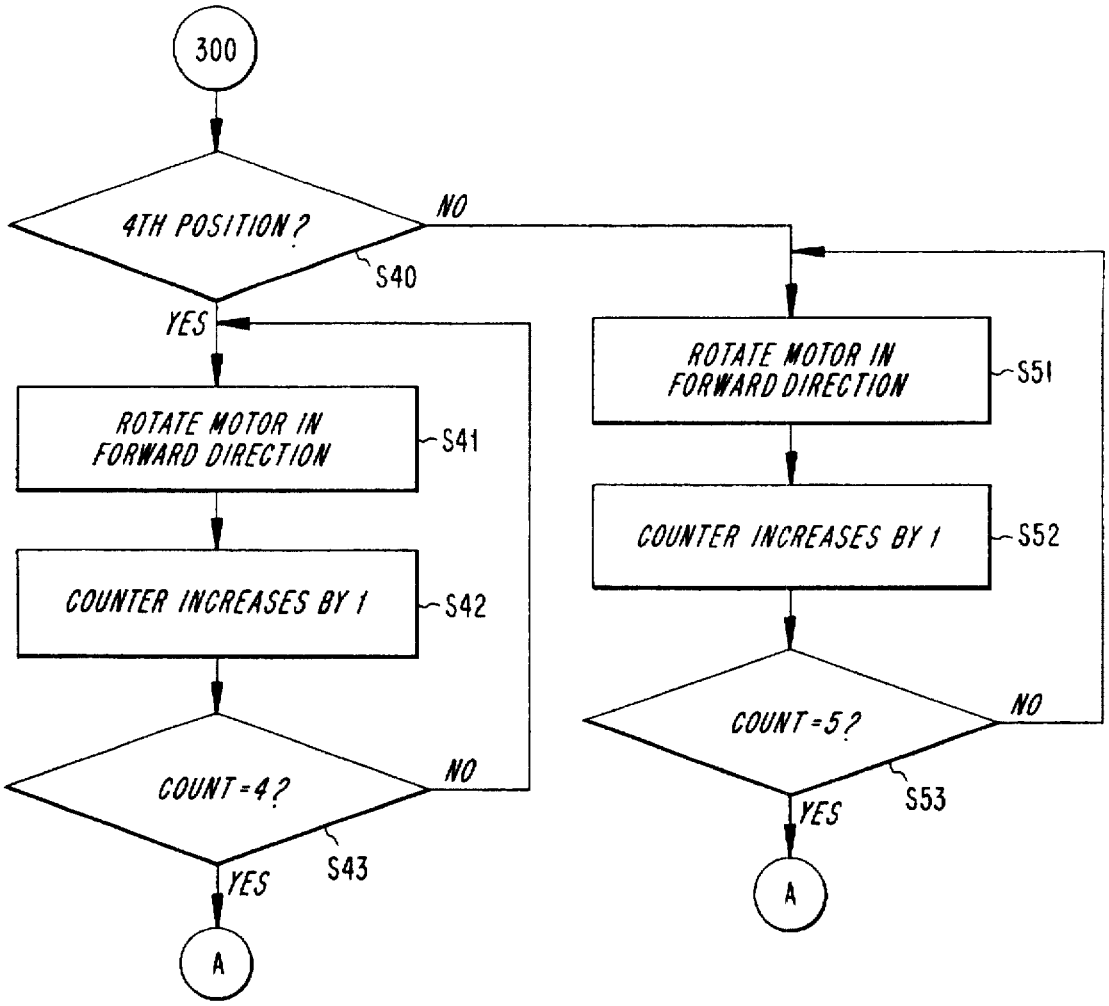

FIG. 4 is a perspective view showing the rear side of the ascending or descending means according to one preferred embodiment of the present invention, and FIG. 9 is flow charts illustrating sequential control procedures for opening or closing the discharge outlet of the air conditioner.

It is assumed that the discharge outlet 104 remains closed as an initial condition for the purpose of the explanation.

First, when a power is applied to the air conditioner, the power supply means 200 performs such that a commercial AC power supplied from an AC power stage 101 is converted into a DC voltage with a voltage level required to activate the air-conditioner, in which the converted DC voltage is applied to the control means 204 and each of the driving circuits.

When a DC voltage from power supply means 20 is applied to control means 204, the air conditioner is initialized by the control means 204. If the user sets the desired operational mode (such as automatic mode, cooling, heating, defrost, air-cleaning, and so forth) and temperature Ts, and then depresses an operation key, an operation selection signal and operation start signal (hereinafter, referred to as an operation signal) are applied to the control means 204.

Thus, at step S1, the control means 204 determines whether the operation signal is applied or not, and if not (in case of NO), it maintains a stand-by of the air conditioner and repeats step S1.

If the operation signal is input (in case of Yes), the process advances to step S2 in which the control means 30 receives an outlet position command corresponding to the position of the discharging means 108 selected by the user who manipulates the door key adjusting key in the key manipulating means 202. Then the control means 204 initializes a counter provided for counting the occurrences of signals detected corresponding to the position of the discharging means 108.

At this time, the control means 204 receives a signal of a high level maintained for a time period, through a start hole 131*a* of the sensor actuating member 131.

Next, at step S4, it is determined whether the outlet position command generated from the manipulation of the outlet position adjusting key corresponds to the first position or not. If yes (in case of YES), the process advances to step S5 where the motor driving means 212 receives from the control means 204 a control signal for adjusting the position of the discharging means 108 to the first position.

Therefore, the motor driving means 212 drives the motor 121 in the forward direction under the control of the control means 204. This allows the pinion 122 coupled to the shaft of the motor 121 to rotate therewith, causing the rack 123 to be moved upward. Thus, the discharging means 108 coupled to the rack 123 ascends to open the discharge outlet 104, wherein the opening of the discharge outlet 104 is varied dependent upon the ascending of the discharging means 108.

As the discharging means 108 ascends due to the forward rotation of the motor 121, the sensor actuating member 131 ascends, during which the light having been passed from the light emitting portion 133*a* to the light receiving portion 133*b* by way of the start hole 131*a* becomes temporarily blocked. This allows a low level signal to be applied to the control means 204 which has previously received the high level signal. With the continued ascending of the discharging means 108, when the first hole 131*b* of the sensor actuating member 131 is placed between the light emitting portion 133*a* and the light receiving portion 133*b*, a high level signal is applied to the control means 204. Then, at step S6, since the counter increases by 1 each time the high signal from the photo-sensor 133 is input, the control means 204 knows the position of the discharging means 108.

At this time, at step S7, to determine whether or not discharging means 108 reaches the first position set by the user through the manipulation of the door position adjusting key, the control means 204 checks whether the content of the counter indicates 1 or not, and if not (in case of NO), the process returns to step S5 where the control means continues to rotate the motor 121 in the forward direction until the content of the counter reaches 1 by repeatedly performing steps S5 to S7.

As a result of the determination at step S7, if the counter has the value 1 (in case of YES), the process advances to step S8 where the control means 204 determines that the discharging means 108 has moved from the start hole 131*a* to the first hole 131*b*, and then stops the motor 121. The ascending of the discharging means 108 is thus completed.

Then, at step S9, in compliance with the operational mode, set temperature and air flow direction established through the key manipulating means 202, the compressor 220 and the indoor fan 222 are driven to condition the room air.

For such a normal operation of the air conditioner, at step S10, it is determined whether the stop command signal generated by an OFF position of the operation key of the key manipulating means 202 is applied, and if not (in case of NO), the process returns to step S9 where the normal operation continues and steps S9 and S10 are repeated.

As a result of the determination at step S10, if the stop command signal is input (in case of YES), the process advances to step S11 where the control means 204 outputs the control signal to the motor driving means 212 for returning to an initial position of the discharging means 108 presently moved to the set position.

Therefore, the motor driving means 212 drives the motor 121 in the reverse direction under the control of the control means 204. This allows the pinion 122 coupled to the shaft of the motor 121 to rotate therewith, causing the rack 123 to be moved downward. Thus, the discharging means 108 coupled to the rack 123 descends to close the discharge outlet 104.

As the discharging means 108 descends due to the reverse rotation of the motor 121, the sensor actuating member 131 descends, during which the light having passed from the light emitting portion 133*a* to the light receiving portion 133*b* by way of the first hole 131*b* becomes temporarily blocked. This allows a low level signal to be applied to the control means 204 which has previously received the high level signal. With the continued descending of the discharging means 108, when the start hole 131 of the sensor driving member 131 is placed between the light emitting portion 133*a* and the light receiving portion 133*a*, a high level signal is applied to the control means 204. Then, at step S12, the counter decreases by 1 each time the high signal from the photo-sensor 133 is input, and then the control means 204 know the present position of the discharging means 108 as it descends.

At this time, at step S13, to determine whether or not discharging means 108 reaches the start position, the control means 204 checks whether the content of the counter exhibits 1 or not, and if not (in case of NO), the process returns to step S11 where the control means continues to rotate the motor 121 in the reverse direction until the content of the counter reaches 0 by repeatedly performing steps S5 to S7.

As a result of the determination at step S13, if the counter has the value 0 (in case of YES), the process advances to step S14 where the control means 204 determines that the discharge outlet door 108 has moved from the first hole 131*b* to the start hole 131*a*, and stops the motor 121. The descending of the discharging means 108 is thus completed. And, the air conditioner maintains the stand-by state until the operational key is activated.

The invention being thus described as to the procedures with the first position established, the same procedures, comprising controlling the driving of motor 121, as described above would be applied to the case of another position established such as 2nd, 3rd, 4th, or 5th positions. More specifically, the control means 204 controls to stop the motor 121 for completing the ascending of the discharging means 108 through step S8 advanced in case after rotating the motor 121 in the forward direction for elevating the discharging means 108, while the detections from the photo-sensor 133 are counted up to 2, 3, 4, and 5 in proportion to the respective ascending positions of the door as in steps S23, S33, S43, and S53, and then the control means 204 stores the above count.

If the user sets the position of the discharging means 108 to the 3rd position through the manipulation of the door position adjusting key, the control means 204 receives initially a high level signal issued when the light emitting portion 133*a* and the light receiving portion 133*b* has the start hole 131*a* interposed therebetween, and subsequently in succession high level signals are issued each time the 1st and 2nd holes 131*b*, 131*c* are interposed between the light emitting portion 133*a* and the light receiving portion 133*b* as the discharging means 108 ascends. During a time period existing between the high level signals, the control means 204 receives a low level signal issued due to a temporary absence of the light to be received at the light receiving portion 133*b* as the sensor actuating member 131 is elevated according to the driving of the door motor 121.

Thus, the control means 204 rotates the motor 121 in the forward direction until the control means 204 receives the high level signal issued when the sensor actuating member 131 reaches the 3rd hole 131*d* to allow the discharging means 108 to ascend to the position corresponding to the 3rd position, and stops the motor 121 when the above high level signal is available.

At this time, the control means 204 stops the discharging means 108 in case the discharging means 108 completes its ascending operation to the target position based upon the counted number of high level signals from the photo-sensor 133, and then the control means 204 stores the above number.

In case the user desires to close the discharge outlet 104 requiring the descending of the discharging means 108, the motor 121 is reversely rotated to cause the discharging means 108 and the sensor actuating member 131 to descend, so that the counter decreases by 1 each time the photo-sensor 133 outputs the high level signal as the light receiving portion 133*b* of the photo-sensor 133 intermittently receives the light in constant time intervals by the respective holes 131*a* to 131*f* encountered during the descending of the sensor actuating member 131.

When the number of the counting is equal to zero, the descending of the sensor actuating member 131 is finished. At this time, since the start hole 131*a* is positioned between the light emitting portion 133*a* and the light receiving portion 133*b*, the motor 121 stops, thus completing the descending of the discharging means 108.

Now the operation principle for performing the movement of the discharging means 108 without requiring a sensor will be explained with reference to FIGS. 4 and 8.

FIG. 4 is a perspective view showing the configuration of the ascending or descending means according to one preferred embodiment of the present invention, and FIG. 8 is a detailed circuit diagram of the main portions applied to the present invention.

When the discharging means 108 is moved up by the forward rotation of the motor 12, and after the lapse of a predetermined time duration in which the motor 121 is driven (the time duration corresponds to a duration required to normally raise or lower the discharging means), a comparison is made between a reference value and the electric current value flowing in a winding of the motor 121, detected by a current detecting portion 210.

For the detected current above the reference value, it is determined that the discharging means 108 has been normally moved up or down, and thus the motor 121 stops.

For the detected current below the reference value even after the time period of the driving of the motor 121 has already lapsed, it is determined that a false operation like idle rotation has occurred. Then, the overall operations are suspended and the occurrence of a false operation is signaled. The preferable position detecting operation of the discharging means 108 without a sensor can be effected accordingly.

Even if the control of the movement of the discharging means 108 can be controlled to arrive at the specific position set by the user, or can perform the controlled movement of the discharging means 108 without using a sensor, a degradation of the door motor 121 may occur due to various causes. To cope with such an occurrence details will be described with reference to FIGS. 5 and 6.

FIG. 5 is a perspective view showing the configuration of the ascending or descending means according to another embodiment of the present invention, and FIG. 6 is a schematic perspective view for explaining a transfer mechanism of an auxiliary motor in FIG. 5.

Due to the degradation of the door motor 141 or 121 in FIG. 4, the time duration which the lower portion of the rack 142 takes to arrive at the reference position may increase and exceeds the reference time duration. The exceeded time duration can be measured by the control means 204 for determining the door motor degradation based upon the counting of the time duration taken to arrive at the reference position of the discharging means 108 by the driving of the motor 141. If the control means 204 determines that the motor has degraded, the auxiliary motor 148 is driven to horizontally move the auxiliary pinion 147 into engagement with the left gear 145 of the rack 143.

When the auxiliary pinion 147 is brought into the engagement with the left gear 145 of the rack 143, the auxiliary motor 148 is rotated together with the motor 104 to move upward or downward the discharging means 108, wherein the rotational speed of the auxiliary motor 148 should be set to be equal to the speed of the motor 141.

When the lower portion of the discharging means 108 reaches the upper (or lower) limiting position with the driving of both the motor 141 and the auxiliary motor 148, both the motor 141 and the auxiliary motor 148 stop, thus the moving operation of the discharging means 108 can be properly performed.

The forgoing disclosure being thus described as to the examination of the performance of the motor 141 by utilizing the position sensors 155, 157, 159, but not limited thereto, a modification can be made such that in case the lower portion of the rack does not arrive at the upper (or lower) limiting position after the lapse of the pre-set time duration, the auxiliary motor 148 is then additionally utilized.

According to the discharge outlet opening or closing apparatus for the air conditioner and the associated method therewith in accordance with the present invention, various ascending or descending positions of the discharging means 108 can be respectively established, thus allowing the discharge outlet 104 to be opened or closed, and the length of the product can be varied. Also, any position of the discharging means 108 can be accurately detected, and the moving operation of the discharging means 108 can be accurately performed using the auxiliary motor 148 driven at the same time, even if the degradation or a malfunction of the motor 121, 141 occurs.

Having described specific preferred embodiment of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An air conditioner comprising:

a housing having an air inlet adjacent a lower portion thereof for admitting air into the housing to be heat exchanged therein;

an air discharge member mounted at an upper end of the housing and including an outlet opening for discharging the heat-exchanged air; the discharge member being movable up and down relative to the housing; the outlet opening being closed by a portion of the housing when the discharge member is in a lowermost position, and being progressively opened in response to being raised;

a drive mechanism for raising and lowering the discharge member;

a detecting mechanism for detecting when the discharge member is in lowermost and uppermost positions, and a controller connected to the drive and detecting mechanisms for controlling the drive mechanism in accordance with signals received from the detecting mechanism.

2. The air conditioner according to claim 1 wherein the controller is connected to a signal input number to enable users to input instructions thereto.

3. The air conditioner according to claim 1 wherein the drive mechanism comprises a motor, a pinion fixed to an output shaft of the motor, a toothed rack fixed to the discharge member and engaged with the pinion, and a stop for stopping the discharge member in its uppermost and lowermost positions, respectively.

4. The air conditioner according to claim 1 wherein the drive mechanism includes a first motor operably connected to the discharge member, and an auxiliary motor movable into operable connection with the discharge mechanism.

5. The air conditioner according to claim 1 wherein the detecting mechanism is operable to detect when the discharge member is in at least one intermediate position between the uppermost and lowermost positions.

6. The air conditioner according to claim 1, wherein the drive mechanism includes an electric motor operably connected to the discharge member; the air conditioner further including stops for terminating movement of the discharge member at its uppermost and lowermost positions, respectively; the detecting mechanism including a position detecting mechanism which detects up and down movements of the discharge member, and a current detecting mechanism for detecting current variations in the motor in response to the discharge member being held by a stop at the uppermost or lowermost position.

7. The air conditioner according to claim 6 wherein the position detecting mechanism comprises a sensor and a sensor-actuating device being movable with the discharge member.

8. The air conditioner according to claim 7 wherein the sensor is a photo-sensor which includes a light emitter and a light receiver, the sensor-actuating device including vertically spaced holes for sequentially conducting light from the emitter to the receiver during up and down movement of the discharge member.

9. The air conditioner according to claim 6 wherein the current detecting mechanism comprises:

a transformer for detecting varying electric current of the motor;

a bridge diode for full-wave rectifying the current detected by the transformer; and a smoothing capacitor for filtering ripple components contained in the full-wave rectified DC current.

10. A method for opening and closing an air outlet of an air conditioner, the air conditioner including a stationary housing and a discharge member mounted on the housing for vertical movement relative thereto, the air outlet being formed in the discharge member and being opened and closed in response to the vertical movement; the method comprising the steps of:

A) selecting a desired position for the discharge member;

B) actuating a drive mechanism which moves the discharge member vertically toward the selected desired position;

C) detecting positions of the discharge member as it moves vertically; and

D) deactuating the drive mechanism automatically when the discharge member reaches the selected desired position.

11. A method for opening and closing an air outlet of an air conditioner, the air conditioner including a stationary housing and a discharge member mounted on the housing for vertical movement relative thereto between upper and lower positions at which the discharge member is halted by respective stops, the air outlet being formed in the discharge member and being opened and closed in response to the vertical movement; the method comprising the steps of:

A) actuating an electric motor to drive the discharge member in a desired vertical direction;

B) detecting a current level in the motor indicative of a current level occurring when the discharge member is stopped; and C) deactivating the motor when such current level is detected.

12. The method according to claim 11, wherein the motor comprises a first motor, and further including the steps of determining when the first motor is malfunctioning, and actuating a second motor for vertically moving the discharge member.

13. The method according to claim 12 wherein the second motor is out of operable engagement with the discharge member during a non-malfunctioning state of the first motor; the step of actuating the second motor being preceded by the step of moving the second motor into operative engagement with the discharge member.

14. The method according to claim 13 wherein the step of determining when the first motor is malfunctioning comprises comparing a time period for the discharge member to be moved to a selected position with a reference time value.

15. The method according to claim 12 wherein the step of determining when the first motor is malfunctioning comprises comparing a time period for the discharge member to be moved to a selected position with a reference time value.

16. The method according to claim 15 wherein the first motor continues to be activated during actuation of the second motor.

* * * * *